US005716289A

United States Patent [19]

Okoneski

[11] Patent Number: 5,716,289

[45] Date of Patent: Feb. 10, 1998

[54] WEIGHTING OF GOLF CLUBS

[76] Inventor: Joseph R. Okoneski, P.O. Box 822, Pismo Beach, Calif. 93448

[21] Appl. No.: 604,375

[22] Filed: Feb. 21, 1996

[51] Int. Cl.[6] ..... A63B 53/14

[52] U.S. Cl. ..... 473/297

[58] Field of Search ..... 473/256, 288, 473/292, 297, 298, 299, 303, 318

[56] References Cited

U.S. PATENT DOCUMENTS

| | | | |
|---|---|---|---|
| 2,023,131 | 12/1935 | Gibson | 473/318 |
| 3,075,768 | 1/1963 | Karns | 473/297 |
| 4,461,479 | 7/1984 | Mitchell | 473/292 |
| 4,690,407 | 9/1987 | Reisner | 473/297 |
| 4,988,102 | 1/1991 | Reisner | 473/297 |
| 5,183,264 | 2/1993 | Lanctot | 473/318 |
| 5,203,561 | 4/1993 | Lanctot | 473/297 |
| 5,244,209 | 9/1993 | Benzel | 473/297 |
| 5,364,102 | 11/1994 | Appledorn | 473/297 |

*Primary Examiner*—Sebastiano Passaniti
*Assistant Examiner*—Stephen L. Blau
*Attorney, Agent, or Firm*—Leo F. Costello

[57] ABSTRACT

A method and apparatus for weighting of golf club handles that basically includes three components, namely, a sleeved receptacle, a weighted rod, and an adhesive. The sleeve is radially resiliently compressible and resiliently compressibly slidably fits inside of the shaft of a golf club at its upper end and resiliently compressibly slidably receives the weighted rod. The adhesive secures the receptacle-rod combination together and in the shaft. More specifically, the receptacle and the adhesive hold the weight centrally in the shaft and cushion it against vibration caused by forces traveling along the shaft when a golf ball is struck. The adhesive is initially placed in the receptacle and the rod is inserted into the receptacle immersing it in adhesive and forcing adhesive out through perforations in the receptacle to coat the exterior of the receptacle. When the receptacle-rod combination is in the golf shaft, outflow of the adhesive also coats the inside of the shaft so that the entire device is firmly held in position in the shaft. The method and apparatus are adaptable to commonly used golf clubs and are adjustable to the needs of individual golfers in that main and auxiliary rods of various weights are used. Tests have shown that a player obtains a better feel of the club, improves control without losing distance, and in fact may gain distance.

24 Claims, 3 Drawing Sheets

WEIGHTING OF GOLF CLUBS

FIELD OF THE INVENTION

The present invention pertains to weighting of golf clubs and more particularly to a method and apparatus for weighting a golf club handle.

BACKGROUND

It is well known that golf clubs which do not have the correct specifications for a particular golfer will affect the golfer's swing and thus the distance and accuracy of the golf shot. One very important specification is club weight and particularly swing weight. In other words, each golf club has a total absolute weight which ranges from about 250 grams to about 400 grams, from the driver to wedge, respectively, with most of this absolute weight in the club head. For example, the weight of the club head in a No. 2 wood is about 200 grams. Each club also has a swing weight that differs from the absolute weight since it involves not only the club weight but also the moment arm of the club during the swing.

For most golfers, it is usually the swing weight that is more significant in that the club may feel too heavy to the golfer during the swing. Many golfers purchase off-the-shelf clubs which may seem to have the correct weight at the time of purchase but feel too heavy on the course. Even where a golfer has clubs designed and fitted to personal specifications and thus presumably are the correct weight, a player may desire to change the club weight after playing a few rounds of golf.

In the past, if a golfer wanted to decrease the swing weight of the clubs, the golfer might change to lighter equipment. This of course can be very expensive, may still not produce the desired results, and very likely will cause the player to lose distance on shots. Another concept for changing the swing weight has been to add weight to the club handle, that is, the butt end of the club. Increasing the weight in the butt of the club moves the center of gravity of the club upwardly along the shaft toward the handle thereby decreasing the moment arm during the swing. The sensation is similar to that of swinging a baseball bat that is held by its thicker, heavier end.

The known techniques for adding weight to a golf club handle, however, have not been satisfactory. Several approaches have been proposed. One approach has been to insert lead shot or BBs in a container in the handle of the club, as in U.S. Pat. Nos. 3,075,768 and 5,244,209. Another approach has been to force-fit a cylindrical weight wrapped in tape or encased in rubber inside the shaft, or to glue a tubular metal weight inside, as in U.S. Pat. Nos. 4,461,479 and 5,364,102. Furthermore, U.S. Pat. Nos. 4,461,479, 4,690,407, and 4,988,102 disclose adding the weight outside of the handle between the handle and the grip.

The main problem with the known methods and devices for adding weight to a golf club handle has been that of securing the weight in the shaft. The known weighting devices disclose various methods, each of which has its disadvantages. With certain of the devices, the weights may not be firmly held in the shaft so that they rattle, cause undesirable vibration, or become loose in the shaft. The weights that are wrapped in tape or encased in rubber may be difficult and unduly complex to assemble and install; may not fit properly in the shaft and thus also may become loose; and do not conveniently lend themselves to selecting different weights to suit different individuals. Other known devices are not readily adapted to the commonly used golf shafts and grips and require a club of special construction to secure the weight.

SUMMARY

A method and apparatus for weighting of golf club handles is provided that basically includes three components, namely, a sleeved receptacle, a weighted rod, and an adhesive. The sleeve is radially resiliently compressible and resiliently compressibly slidably fits inside of the shaft of a golf club at its upper end and resiliently compressibly slidably receives the weighted rod. The adhesive secures the receptacle-rod combination together and in the shaft. More specifically, the receptacle and the adhesive hold the weight centrally in the shaft and cushion it against vibration caused by forces traveling along the shaft when a golf ball is struck. The adhesive is initially placed in the receptacle and the rod is inserted into the receptacle immersing it in adhesive and forcing adhesive out through perforations in the receptacle to coat the exterior of the receptacle. When the receptacle-rod combination is in the golf shaft, outflow of the adhesive also coats the inside of the shaft so that upon curing of the adhesive, the entire device is firmly held in position in the shaft. The method and apparatus are adaptable to commonly used golf clubs and are adjustable to the needs of individual golfers in that main and auxiliary rods of various weights are used. Tests have shown that a player obtains a better feel of the club, improves control without losing distance, and in fact may gain distance.

An object of the present invention is to improve a golfer's control of a golf club during the golf swing.

Another object is to improve accuracy and distance of a golf shot by adding weight to the handle of a golf club.

A further object is to decrease the swing weight of a golf club.

Another object is to secure a weight in the handle of a golf club in a dependable manner.

Yet another object is provide a weighting device that is easy to install in a golf club handle.

A further object is enable weight to be added to a golf club handle of commonly available golf clubs.

Another object is to enable various amounts of weight to be added to a golf club handle to suit the needs of individual players.

Still another object is to improve the application of adhesive to the inside of a golf club shaft and to all surfaces of a weight inserted in the shaft.

A further object is to secure a weight inside the shaft of a golf club so that it is firmly held in place in the shaft without the possibility of becoming loose, rattling, or causing vibration.

A feature of this invention is to mount a weight inside the shaft of a golf club so that it is firmly held in position but is cushioned against vibrations transmitted through and along the shaft when a golf ball is struck by the club head attached to the shaft.

These and other objects, features and advantages of the present invention will become apparent upon reference to the following description, accompanying drawings, and appended claims.

DESCRIPTION OF THE DRAWINGS

FIG. 6*a* is a lower end view of the receptacle.

FIG. 7*a* is a side elevation of the rod.

DETAILED DESCRIPTION

Figure 1:
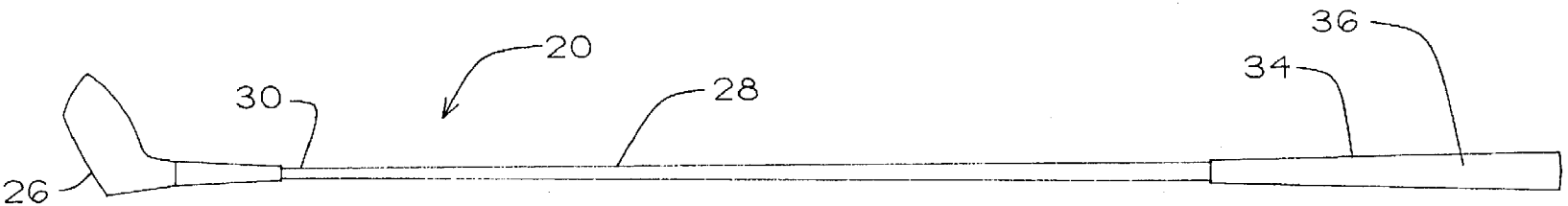
FIG. 1 is a side elevation of a golf club, in this case a driver or wood.
Figure 2:
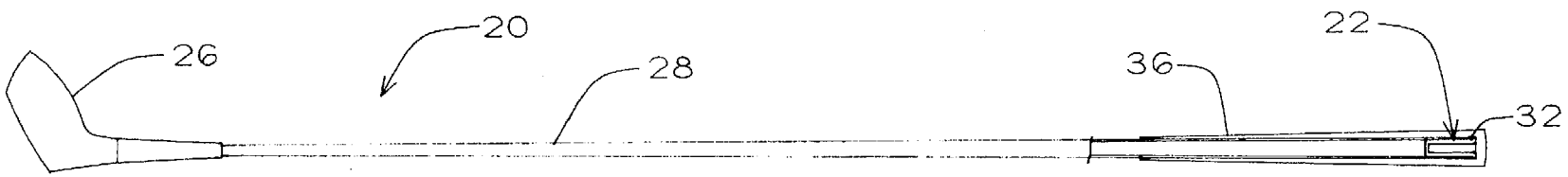
FIG. 2 is a side elevation of the golf club shown in FIG. 1 with the grip and shaft at the handle end of the club being broken away to show the weighting device of the present invention within the shaft.
Figure 3:
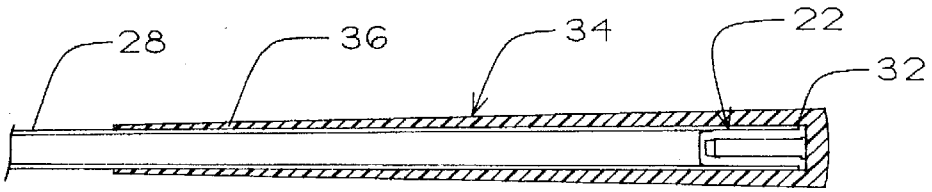
FIG. 3 is an enlarged foreshortened longitudinal section of the shaft and grip of the golf club of FIG. 2 also showing the weighting device installed.

A golf club 20 having a weighting device 22 incorporating the principles of the present invention is shown in FIGS. 1–4. The golf club shown in FIGS. 1 and 2 is a wood or driver, but the subject weighting device can be incorporated in any club from a No. 1 wood to any of the wedges and even in a putter. The golf club includes a club head 26; a tubular shaft 28 that has a lower end 30 connected to the head and an open upper end 32; and a handle 34 composed of the upper end of the shaft and a grip 36 fitted over and adhesively bound to the upper end of the shaft. The handle is also known as the butt end of the club. It will be recognized that the basic parts of the golf club described are those commonly existing in conventional golf equipment. One of the advantages of the present invention is that it is easily installed in commonly used golf clubs. More specifically, the weighting device will fit all major brands of graphite shafts and all metal shafts.

Figure 4:
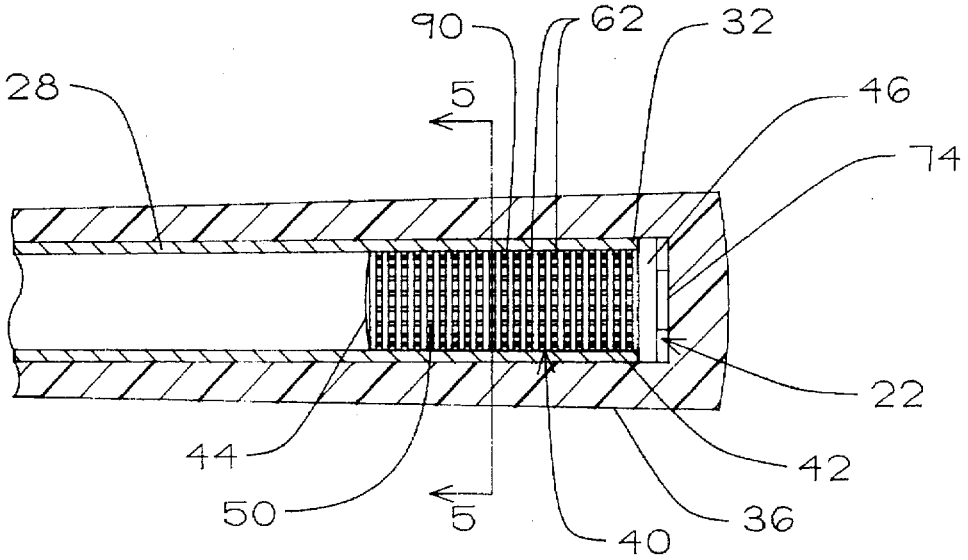
FIG. 4 is a still further enlarged fragmentary longitudinal cross-section of the golf club shaft and grip and showing the subject weighting device in side elevation.
Figure 5:
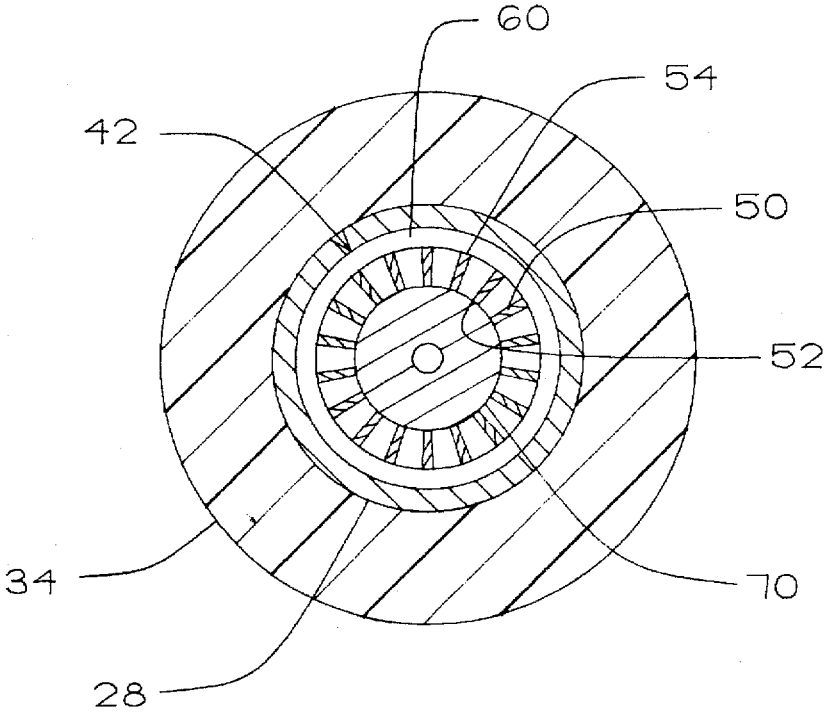
FIG. 5 is an enlarged transverse section taken on line 5—5 in FIG. 4.
Figure 6A:
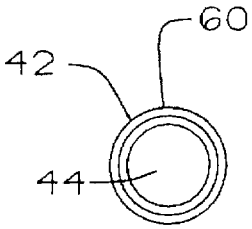
FIGS. 6*a*, *b*, and *c* are detail views of the receptacle of the weighting device shown in FIGS. 4 and 5 but on the same scale as FIG. 4 which is just slightly larger than the full scale of the preferred embodiment.
Figure 6B:
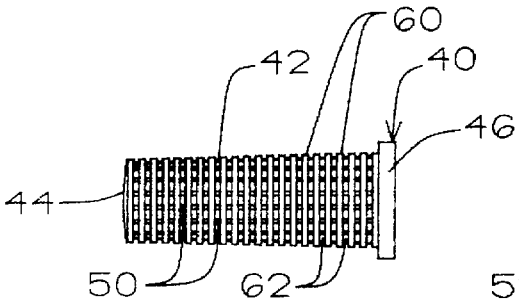
FIG. 6*b* is a side elevation hereof.
Figure 6C:
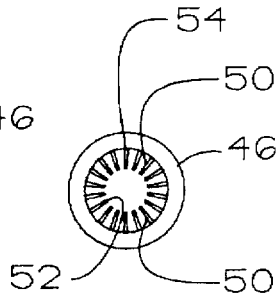
FIG. 6*c* is an upper-end view of the receptacle.

With particular reference to FIGS. 4–6, the weighting device 22 includes a plastic receptacle 40, preferably molded of high density polyethylene. The receptacle includes a perforated sleeve 42, a closed lower end wall 44, and an annular upper end rim 46. The sleeve has several characteristics that are important in the weighting device 22 and is thus described in some detail. The sleeve is formed by a plurality of elongated longitudinal fins 50 (FIGS. 5, 6*b* and 6*c*) equally spaced circumferentially of the sleeve. These fins have inner and outer edges 52 and 54 respectively tangential to an imaginary inner and outer cylinders coaxial with the sleeve.

The sleeve 42 (FIG. 6) also includes a plurality of annular fins 60 which circumscribe the longitudinal fins 50 and are equally longitudinally spaced along the length of the sleeve. The annular and longitudinal fins are joined or integral where they intersect and define a plurality of equally spaced apertures or perforations 62 over the entire periphery of the sleeve. Such apertures, of course, provide communication between the exterior and interior of the sleeve. Because of the material used and the described structure, the receptacle 40 exhibits considerable axial rigidity against forces imposed axially inwardly against the end wall 44 and the rim 46. The sleeve, however, is transversely resiliently compressible with regard to forces applied radially inwardly and outwardly of the sleeve against the fins.

The sleeve 42 is tapered outside from the upper rim 46 to the lower end wall 44, and thus is frusto-conical. Stated otherwise, the outer diameters of the annular fins gradually decrease from the annular fin adjacent to the rim to the annular fin adjacent to the end wall so that the outer diameter of the sleeve gradually decreases from the upper end to the lower end. These diameters are such that the receptacle will slidably fit and be completely and snugly received in the open upper end 32 of the golf club shaft 28 with the rim 46 seated against the end 32 of the shaft 28. More specifically, the minimum outside diameter of the sleeve is less than the inside diameter of the shaft at its upper end, and the maximum outside diameter of the sleeve is greater than the inside diameter of the shaft so that the fins engaging the shaft will be resiliently compressed by the engagement and insure a snug fit. The length of the receptacle is such that it occupies only the extreme upper end of the shaft which, in the preferred embodiment shown and described is about ⅙th of the length of the grip 36, it being understood that this relationship is not critical. Receptacles of various lengths are used to accommodate different weights, as will be described. The sleeve 42 is also tapered on the inside from the upper rim 46 to the lower end wall 44 similarly to the outside. The longitudinal fins collectively converge from the upper rim to the end wall so that the inner diameter of the sleeve gradually decreases from the upper end to the lower end.

Figure 7A:
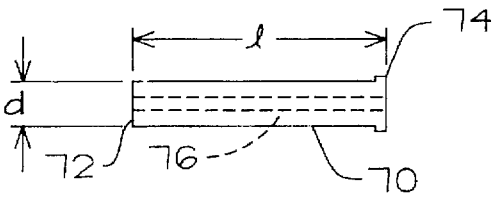
FIGS. 7*a* and *b* are detail views of the main rod of the weighting device.
Figure 7B:
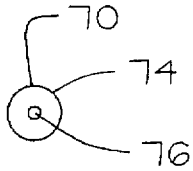
FIG. 7*b* is an upper end view of the rod.

The weighting device 22 also includes a main or outer cylindrical tubular weighting rod or insert 70 (FIG. 7) which is made of any suitably dense material, preferably lead or other dense metal. The rod has a lower end 72, an upper end or collar 74, and a longitudinal bore 76 extending from the upper end of the rod axially into the rod. The rod has a diameter "d" and a length "l" such that the rod will fit in the receptacle 40. First, the length of the rod is less than the length of the receptacle. Secondly, the outside diameter of any particular rod 70 is uniform throughout its length and is slightly larger than the inside diameter of the sleeve 42 at some position axially thereof. Various sizes of main rods are used to achieve various weights, but they all have an outside diameter that is slightly greater than the inside diameter of the sleeve at some point therealong. The size relationship is such that the rod can be slidably fitted and completely received in the receptacle 40 with the collar seated against the rim 46 and with the longitudinal fins resiliently compressed by the rod to insure a snug fit.

As previously alluded to, rods 70 of various weights are used to enable the handle or butt end 34 of the golf club 20 can be weighted to suit individual needs. This variation in weight is achieved by using rods of various lengths "l" and outside diameters "d" thereby to increase or decrease the volume of the weighting material, as lead, that is used. Examples of the widths and lengths of the main rod are set forth below. As mentioned above, the receptacle may be increased in length to receive longer rods and thereby increase the weight used.

An additional way of changing the weight of the main rod 70 is an auxiliary or inner rod or pin or insert 80 (FIG. 9) that is preferably of the same material as the main rod but of a lesser weight. The auxiliary rod has a uniform external diameter approximately equal to the diameter of the bore 76 in the main rod. The auxiliary rod is provided in various lengths depending on the amount of weight to be added. Thus the auxiliary rod can be slidably and snugly fitted into the bore so that it will not move either transversely or axially relative to the main rod.

Thus, the weighting device 22 is located in the upper end of the golf club shaft 28 and is secured therein by an adhesive 90 (FIGS. 4 and 9) that has resilient flexibility when cured, such as a silicone adhesive. More particularly, the adhesive is placed in the receptacle 40 before inserting the main rod 70 so that upon insertion thereof, the rod is immersed in adhesive and spreads the adhesive over the interior of the sleeve. Moreover, insertion of the rod forces the adhesive out of the perforations to coat the exterior of the sleeve and the inside surface of the shaft. If the auxiliary rod 80 is used, it may also be dipped in adhesive before inserting into the bore 76.

The principles of the present invention do not depend on any particular dimensions, but specific approximate dimensions of the preferred embodiment of the weighting device 22 are provided by way of example. Thus, in the preferred embodiment, the receptacle 40 has an overall length of 3.7 cms. and a sleeve length of 3.4 cms from the end wall 44 to the rim 46. The sleeve has a maximum outside diameter of 1.2 cms., a minimum outside diameter of 1 cm, a maximum inside diameter of 0.8 cm., and a minimum inside diameter of 0.6 cm. Since the standard inside diameter of a golf club shaft, as 28, at its upper open end 32, is about 1.1 cm, it will be understood that when the sleeve 42 is inserted in the upper end of the shaft, the sleeve will be compressed by the shaft, as has been described.

The dimensions of the main rod 70, as explained above, vary according to the amount of weight to be added. In general, and depending on the individual golfer and the club involved, it has been determined that the objects of the invention are achieved with added weights in a broader range of from 5 grams to 50 grams, although a more narrow range of from 8 grams to 20 grams covers most normal situations, with the added weight averaging about 10 grams. Since the weighting device includes three (or perhaps four) basic parts, namely, the receptacle 40, the main rod 70, and the adhesive 90, (and possibly the auxiliary rod 80, if used), and each has weight, the combined weight of these parts is the weight of the weighting device 22 being added. The receptacle weighs about 1 gram; and the adhesive weight, depending on the amount used, can range up to about 5 grams, thus leaving from about 3 grams to about 44 grams of weight for the rods 70 (and 80) to be added, insofar as the broader range above is concerned, or from about 6 grams to about 14 grams, insofar as the narrower range is concerned, with an average of about 4 or 5 grams.

With these weight considerations in mind, various sizes of the main rod 70 are provided wherein the length "l" of the rod, assuming a receptacle length of about 3.7 cms, varies from about 1.2 cm to just short of the length of the receptacle, that is about 3.5 cms., and wherein the diameter "d" of the rod varies from about 0.7 cm to about 0.8 cm. The diameter of the bore 76 is about 0.3 cm, and the diameter of the auxiliary rod 80 is just under 0.3 cm so as to fit in the bore. The length of the auxiliary rod is slightly less than the length of the bore, but may be shorter. If more weight is desired, a longer receptacle may be used, allowing for a longer rod.

METHOD OF INSTALLING THE WEIGHTING DEVICE

When a golfer desires to have more weight in his or her hands in order to decrease the swing weight of the golf club 20, the subject weighting device 22 is very easily and readily installed in a custom installation in order to provide such weight. Preferably, however, the weighting device is installed at the time the club is manufactured. In either case, the installation takes place with the grip 36 removed from the shaft 2 (FIGS. 1–4), thereby exposing the open upper end 32 of the shaft. Before installation, the receptacle 40, the rod 70 and the adhesive 90 are of course all separate. Initially, the size of weighted rod 70 to be used is selected. For a custom installation, this decision depends on the golfer and club involved and is reached by having the golfer try out several clubs with various weights of weighted devices installed. For a manufactured installation directed toward the average recreational golfer, a rod having an average weight in the 10 to 20 gram range is preferably selected. The method steps described below are intended for a custom installation, it being understood that the essential difference in a manufactured installation would be that the steps would be mechanized as much as possible.

Figure 8:
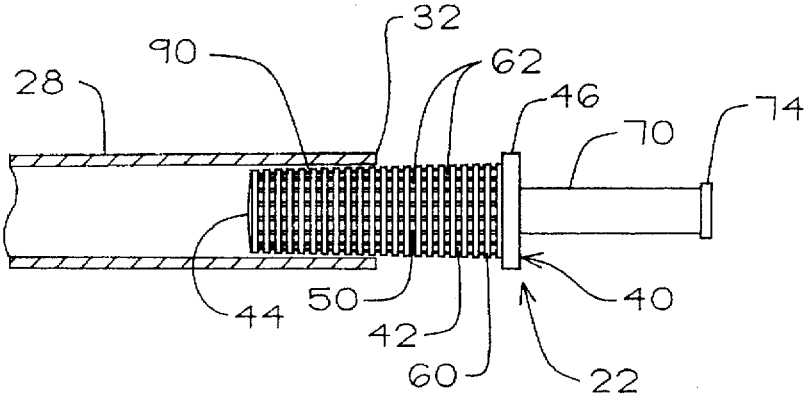
FIG. 8 is a fragmentary longitudinal section of the golf club shaft, on the same scale as shown in FIG. 4, and a side elevation of the weighting device as it appears during one method of installation of the device into the shaft.

After weight selection, a small amount of the adhesive 90 is placed inside the receptacle 40 through the upper open end thereof, it being understood that this adhesive remains in a liquid or uncured state during the installation steps which follow. The receptacle 40 containing the adhesive is slidably compressibly fitted as far as it will penetrate under manual pressure (FIG. 8) into the open upper end 32 of the golf club shaft 28. Since this fit is snug, a hammer and punch may be used to tap the receptacle fully into the shaft until the rim 46 engages the upper end of the shaft whereupon the receptacle is fully seated in the shaft (FIG. 9).

Figure 9:
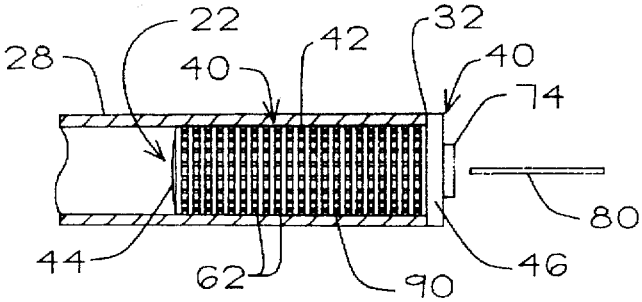
FIG. 9 is a view similar to FIG. 8 but showing the receptacle and main rod fully inserted in the golf club shaft and an auxiliary rod in position to be inserted into the main rod.

Next, the main rod 70 (FIG. 8) is inserted into the sleeve 42 of the receptacle 40 through its open upper end and compressibly slidably fitted into the sleeve until the collar 74 engages the upper end of the receptacle (FIG. 9). Again, use of a hammer and punch will facilitate driving of the rod into the sleeve. Insertion of the main rod into the sleeve causes the adhesive 90 in the receptacle to be forced outwardly through the apertures 62 in the sleeve so that the adhesive will flow onto the adjacent inner surface of the shaft 28 and onto all of the external surfaces of the longitudinal and annular fins 50 and 60. Of course, the adhesive will also coat the exterior of the rod as well as the interior surfaces of the fins. In sum, the adhesive will flow to all adjacent surfaces of the shaft and the weighting device 22 and occupy virtually all of the available interstices. The adhesive is then allowed to cure, and when cured, the shaft, the receptacle, and the outer rod will be interconnected and the weighting device will be firmly held within the shaft. It is to be noted that, for illustrative clarity, the adhesive 90 is not shown in the drawings since it would cover the receptacle and obscure its features, but the numeral 90 and a lead line indicate the presence of the adhesive.

After the weighting device 22 has been thusly installed in the handle 34, the grip 36 is installed on the shaft 28 in the usual manner. It will be noted in FIG. 4 that the upper rim 46 and the collar 74 extend slightly endwardly from the upper end 32 of the shaft and are thus interposed the end of the shaft and the inside surface of the end of the grip. In the preferred embodiment, the axial length of the combined rim and collar is less than 0.5 centimeters so that the presence of the weighting device does not significantly change the normal relationship between the grip and the shaft.

A slightly modified method of installing the weighting device 22 is as follows: a small mount of adhesive 90 is initially placed in the receptacle 40, as before. Next, however, the main rod 70 is inserted, and if necessary, driven by a hammer and punch, into the receptacle until the collar 74 engages the upper end thereof. As before, sliding of the rod into the receptacle causes the adhesive to flow outwardly through the perforations 62 and coat the exterior of the sleeve. The receptacle is then inserted into the upper end 32 of the shaft 28 and driven by a hammer and punch into its fully seated position with the rim 46 engaging the end of the shaft. Insertion of the receptacle causes further exuding or seeping of the adhesive onto the surface of the sleeve and the inner surface of the shaft, resulting in the interconnection and firm mounting of the weighted rod, as described above.

With the weighting device 22 installed in the manner described above and as shown in FIGS. 3 and 4, several features are to be noted. First, the weighting device adds between 5 and 50 grams, of weight to the overall club weight, depending upon the needs of the particular golfer. For custom installations, usually for the more experienced golfer, experience has shown that the amount of added weight is about 10 grams on average. For manufactured installations, usually for the average golfer, it may be preferred to add about 20 grams or more. It is to be emphasized that the amount of weight added is not a limitation on the present invention and may be varied to suit individual needs. In any installation, however, and in accordance with the present invention, this weight is added to the butt end of the club to decrease the swing weight of the club without otherwise interfering with how the club is handled or feels during the swing.

It is very significant that the subject weighting device 22 dependably holds the weighted rod 70 securely within the shaft 28. Such dependability is achieved because the rod is securely held within the receptacle 40, the receptacle is securely held in the shaft 28, and the adhesive 90 extends through the perforations 62 in the sleeve 42 to engage both the interior and exterior surfaces of all of the parts involved. In addition, the rod is resiliently compressibly received in the sleeve, and the sleeve is resiliently compressibly received in the shaft. Together with the resilience of the cured adhesive, the rod is thus essentially isolated from shocks which are transmitted along the shaft 28 when the golf ball is struck with the club head 26.

The weighting device 22 of the present invention is very easy to install in a golf club shaft 28 whether at the factory or in the pro shop or golf store. In either case, after the weighting device has been installed, and the golfer uses the club or clubs in playing one or more rounds of golf, the golfer may decide that additional weight is desired. If so, the subject invention provides for weight to be added, as best illustrated in FIG. 9. To add weight, the grip 36 is removed thereby to expose the upper end 74 of the outer rod 70. An auxiliary rod 80 of a few grams is then slidably inserted into the bore 76. In this manner, several more grams of weight can be added. In order to secure the inner rod in the bore, the inner rod may be coated with adhesive before sliding it into the bore.

It will thus be understood that a method and apparatus for weighting the butt end or handle 34 of a golf club 20 has been shown and described that includes essentially three parts: a receptacle 40, a rod 70, and an adhesive 90, with the auxiliary rod 80 constituting a possible fourth part if used. The weighting device 22 is dependably mounted centrally in the shaft 28 and cushioned against vibration caused by forces traveling along the shaft when a golf ball is struck. An important feature is the perforations in the sleeve 42 which allow the adhesive to flow both inwardly and outwardly to coat the inside of the shaft, the rod, and the sleeve so that the entire device is firmly held in position in the shaft. The method and apparatus are adaptable to commonly used golf clubs and are adjustable to the needs of the individual golfers. Experience has shown that a player obtains a better feel of the club with the subject weighting device so as to improve control without losing distance. In fact, tests have shown that the subject weighting device enables a player to obtain more distance on shots.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A weighted golf club handle which includes a shaft with a tubular upper end and a grip fitted, over said upper end, comprising:

a resiliently compressible sleeve resiliently compressibly fitted inside of the shaft at said upper end; and a weighted insert resiliently compressibly fitted in and held by the sleeve throughout substantially the entire dimension of the insert lengthwise of the shaft.

2. The weighting device of claim 1:

wherein the sleeve is made of polyethylene.

3. The weighting device of claim 1:

wherein the insert is made of lead.

4. The weighting device of claim 1:

wherein the insert is cylindrical.

5. A weighting device for a golf club handle which includes a shaft with a tubular open upper end and a grip fitted over said upper end, comprising:

a resiliently compressible sleeve adapted to be resiliently compressibly slidably fitted inside of the shaft of a golf club at its upper end prior to placing the grip on the shaft, a weighted insert resiliently compressibly slidably fitted in the sleeve, and means for securing the insert in the sleeve and the sleeve in the shaft whereby the sleeve is resiliently compressibly fitted in the shaft, wherein the securing means extends through the sleeve and interconnects the insert and the sleeve and is adapted to connect to the shaft.

6. The weighting device of claim 5, wherein said sleeve is perforated, and wherein said securing means is an adhesive contacting the outside of the insert and the inside surface of the sleeve, extending through the perforations of the sleeve, contacting the outside surface of the sleeve, and adapted to contact the inside surface of the shaft.

7. A weighting device for a golf club handle which includes a shaft with a tubular open upper end and a grip fitted over said upper end, comprising:

a resiliently compressible sleeve adapted to be resiliently compressibly slidably fitted inside of the shaft of a golf club at its upper end prior to placing the grip on the shaft, a weighted insert resiliently compressibly slidably fitted in the sleeve, and means for securing the insert in the sleeve and the sleeve in the shaft whereby the sleeve is resiliently compressibly fitted in the shaft, wherein said weighted insert is an outer tubular insert, and wherein an inner weighted insert is compressibly slidably fitted in the outer insert and has a weight less than the weight of the outer insert.

8. A golf club having a shaft with a tubular upper end and a grip fitted over said upper end, comprising:

an elongated weighted rod positioned in the upper end of the shaft and circumferentially spaced therefrom, mounting means interposed the shaft and the rod resiliently compressibly mounting the rod in the shaft and cushioning the rod against vibrations of the shaft, and adhesive means in contact with the rod and extending through the mounting means for adhering the mounting means to the shaft.

9. The golf club of claim 8:

wherein the adhesive means is in enveloping contact with the rod.

10. A weighting device for a golf club which has a shaft with a tubular upper end and a grip fitted over said upper end, said shaft having an inside surface, comprising:

an elongated, longitudinally rigid, cup-shaped receptacle positioned in the upper end of the shaft, said receptacle having a tubular wall which is radially resiliently compressible, said wall having a plurality of fins projecting radially outwardly in compressible engagement with the inside surface of the shaft so that the wall of the receptacle is resiliently compressed by such engagement, and a weighted rod positioned in the receptacle and having an outside surface, said wall of the receptacle having a plurality of fins projecting radially inwardly in compressible engagement with the outside surface of the rod so that the wall of the receptacle is resiliently compressed by such engagement, whereby the rod is resiliently compressibly held in the shaft by the receptacle.

11. The weighting device of claim 10, wherein the rod is slidably insertable into the receptacle, wherein the receptacle has openings therein, wherein adhesive is in the receptacle, and wherein slideable insertion of the rod into the receptacle forces adhesive out of the openings into engagement with the shaft thereby to secure the receptacle to the shaft and the rod to the receptacle.

12. A weighting device for the butt end of a golf club which has a shaft with a tubular open upper end and a grip fitted over said upper end, said upper end having a predetermined internal diameter comprising:

a plastic receptacle which includes an elongated radially resiliently compressible sleeve having a closed lower end and an open upper end, said receptacle having an annular rim at it upper end, said sleeve being fitted in the upper end of the shaft with the rim engaging the shaft, said sleeve being formed by a plurality of rectangular longitudinal fins having longitudinal dimensions extending lengthwise of the sleeve and transverse dimensions extending radially of the sleeve, said longitudinal fins being spaced substantially equally about the circumference of the sleeve and having longitudinal inner edges within the sleeve and longitudinal outer edges outside of the sleeve, said sleeve also being formed by a plurality of annular fins circumscribing the longitudinal fins around their outer edges and spaced substantially equally lengthwise of the sleeve, said longitudinal and transverse fins thereby defining a plurality of apertures which extend between the interior and exterior of the receptacle, the sleeve having an outside diameter which is tapered from its upper end to its lower end, the diameter of the sleeve at least along an upper portion thereof being greater than the inside diameter of the shaft so that the annular fins are in resiliently compressible engagement with the shaft circumferentially thereof, an elongated cylindrical rod of lead positioned in the sleeve with the inner edges of the longitudinal fins resiliently compressibly engaging the rod circumferentially thereof, and an adhesive within the sleeve and coating the rod between the interior of the sleeve and the rod, extending through the apertures, and coating the exterior of the sleeve and the interior of the shaft between the shaft and the sleeve so that the sleeve is immovably secured within the shaft and rod is immovably secured within the sleeve.

13. The weighting device of claim 12, wherein the club has a total weight which ranges from about 250 grams to about 400 grams:

wherein the sleeve, the rod, and the adhesive have a weight in the range of from about 5 to 50 grams.

14. The weighting device of claim 12:

wherein the rod is an outer rod which is solid except for a bore extending lengthwise thereof, and wherein an inner elongated cylindrical rod of lead is compressibly slidably fitted in said bore.

15. The weighting device of claim 14, wherein the inner rod has a weight which is less than the weight of the outer rod.

16. A method of weighting a golf club which has a shaft with an open upper end and a grip, said method involving the use of a tubular receptacle having an outside diameter slightly larger than the inside diameter of the shaft, and a weight that is slightly larger than the inside diameter of the receptacle, comprising the steps of:

compressibly fitting the weight into the receptacle and the receptacle into the upper end of the shaft whereby the receptacle is compressibly held in the shaft and the weight is compressibly held in the receptacle throughout substantially the entire dimension of the weight lengthwise of the shaft.

17. A weighted golf club handle that is made using the method of claim 16.

18. A method of weighting a golf club which has a shaft with an open upper end and a grip, said method involving the use of a perforate tubular receptacle having an outside diameter slightly larger than the inside diameter of the shaft, and a weight that is slightly larger than the inside diameter of the receptacle, comprising the steps of:

compressibly fitting the weight into the receptacle and the receptacle into the upper end of the shaft whereby the receptacle is compressibly held in the shaft and the weight is compressibly held in the receptacle, and placing liquid adhesive in the receptacle before placing the weight therein so that fitting the weight into the receptacle causes the adhesive to flow around the weight and adhesively join the weight and the receptacle and to flow through the perforations and adhesively join the shaft and the receptacle.

19. A method of weighting a golf club which has a shaft with an open upper end and a grip, said method involving the use of a tubular receptacle having an outside diameter slightly larger than the inside diameter of the shaft, and a weight that is slightly larger than the inside diameter of the receptacle, comprising the steps of:

compressibly fitting the weight into the receptacle and the receptacle into the upper end of the shaft whereby the receptacle is compressibly held in the shaft and the weight is compressibly held in the receptacle, wherein the weight is first fitted in the receptacle, and then the receptacle is fitted in the shaft.

20. A method of weighting a golf club which has a shaft with an open upper end and a grip, said method involving the use of a tubular receptacle having an outside diameter slightly larger than the inside diameter of the shaft, and a weight that is slightly larger than the inside diameter of the receptacle, comprising the steps of:

compressibly fitting the weight into the receptacle and the receptacle into the upper end of the shaft whereby the receptacle is compressibly held in the shaft and the weight is compressibly held in the receptacle, wherein the receptacle is first fitted in the shaft, and then the weight is fitted in the receptacle.

21. A method of weighting a golf club which has a shaft with an open upper end and a grip, said method involving the use of a tubular receptacle having an outside diameter slightly larger than the inside diameter of the shaft, and a weight that is slightly larger than the inside diameter of the receptacle, comprising the steps of:

compressibly fitting the weight into the receptacle and the receptacle into the upper end of the shaft whereby the receptacle is compressibly held in the shaft and the weight is compressibly held in the receptacle, wherein the receptacle is partially fitted in the shaft, then the weight is partially fitted in the receptacle, and then both the receptacle is fully tapped into the shaft and the weight is fully tapped into the receptacle.

22. A method of weighting a golf club handle which has a shaft with an open upper end and a grip, said method involving the use of a receptacle having a perforate, radially resiliently compressible tubular wall that is resiliently compressibly insertable into the open upper end of a golf club and a weight that is resiliently compressibly insertable into the receptacle, comprising the steps of:

placing a liquid adhesive in the receptacle, and compressibly fitting the weight into the receptacle and the receptacle into the upper end of the shaft whereby the adhesive is forced to flow around the rod between the rod and the receptacle and out of the perforations around the exterior of the receptacle between the receptacle and the shaft so as to interconnect the shaft, receptacle and the rod.

23. The method of claim 22, including the further steps of:

curing the adhesive, and attaching the grip to the club.

24. A golf club including a weighting device in the handle wherein the golf club is weighted using the method of claim 22.

* * * * *